US009526308B2

(12) United States Patent
Burko

(10) Patent No.: US 9,526,308 B2
(45) Date of Patent: Dec. 27, 2016

(54) FOLDABLE SMALL ITEM HOLDER

(71) Applicant: Elad Burko, Valley Stream, NY (US)

(72) Inventor: Elad Burko, Valley Stream, NY (US)

( * ) Notice: Subject to any disclaimer, the term of this patent is extended or adjusted under 35 U.S.C. 154(b) by 103 days.

(21) Appl. No.: 14/536,350

(22) Filed: Nov. 7, 2014

(65) Prior Publication Data

US 2016/0128437 A1 May 12, 2016

(51) Int. Cl.

| | |
|---|---|
| ***A45C 1/06*** | (2006.01) |
| ***A45C 7/00*** | (2006.01) |
| *B65D 83/04* | (2006.01) |

(52) U.S. Cl.

CPC ..... *A45C 1/06* (2013.01); *A45C 7/0077* (2013.01); *B65D 83/0481* (2013.01)

(58) Field of Classification Search

CPC ..... B65D 31/12; B65D 83/0481
USPC ..... 150/150, 136, 146
See application file for complete search history.

(56) References Cited

U.S. PATENT DOCUMENTS

2009/0235735 A1* 9/2009 Tsypko ..... G01F 1/6847 73/204.24

FOREIGN PATENT DOCUMENTS

JP 1028608 * 7/1996

* cited by examiner

*Primary Examiner* — Anthony Stashick
*Assistant Examiner* — Mollie Impink
(74) *Attorney, Agent, or Firm* — Feldman Law Group, P.C.; Stephen E. Feldman

(57) ABSTRACT

A small item holder for holding small items that includes a pocket opened on one side and formed from a thin material. The pocket can include a guide stich having a first end in close proximity to a corner of the pocket near the opening and a second end at a centerline of the pocket slightly below the opening. The guide stich can be positioned parallel to or at an angle and with respect to the opening. The pocket can further include a partition stich being partially positioned along the centerline of the pocket. The partition stich can start at the second end of the guide stich and continue to an approximate midpoint of the centerline. The partition stich partitions the pocket into a first compartment and a second compartment with the first compartment and the second compartment being interconnected.

14 Claims, 8 Drawing Sheets

FOLDABLE SMALL ITEM HOLDER

BACKGROUND

The present invention relates to a foldable small item holder.

There are a number of ways to carry spare change from storing change in a storage pocket of a purse to holding loose change in a pocket of a clothing article. When using a pocket of a clothing article, the change is stored loose and is difficult to keep track off, for example, if the change is stored with other objects like keys, when the keys are removed from the pocket, invariably the change will follow and fall on the floor. Also, some clothing articles have small change pockets built into the article but these pockets are usually tight and removing change from the pocket requires removing one coin at a time and it may not be the coin needed. If storing change in a purse, it is common to change purses on a regular basis to match the clothing to be worn that day. To remove the change, the purse is usually turned over so the change will fall out. This process can lead to change falling on the floor.

SUMMARY

The present invention provides for a foldable small item holder. The foldable small item holder can be easily inserted into a pocket of a clothing article, e.g., a change pocket of a pair of jeans, so that removal of the coins and other small items, e.g., memory cards, jewelry, from the pocket of the clothing article is easy. The small item holder can also be inserted into a storage pocket of a purse so that removal of the small items from the small item holder can be done with ease.

In one implementation, a small item holder can be a pocket opened on one side and formed from a thin material. The pocket can include a guide stich having a first end in close proximity to a corner of the pocket near the opening and a second end at a centerline of the pocket slightly below the opening. The guide stich can be sewn at a downward angle from the first end to the second end with respect to the opening. The pocket can further include a partition stich being partially sewn along the centerline of the pocket. The partition stich can start at the second end of the guide stich and continue to an approximate midpoint of the centerline. The partition stich partitions the pocket into a first compartment and a second compartment with the first compartment and the second compartment being interconnected.

In some implementations, the thin material can be a spun-bonded olefin material, a thin leather, a fabric or a cloth material. In some implementations, a design can be printed or painted on the thin material.

In some implementations, the first compartment and the second compartment can be interconnected below the partition stich. In some implementations, the downward angle of the guide stich can be in a range from approximately 0-60 degrees. In some implementations, the pocket has four sides, e.g., a square but may also be rounded, V-shaped, trapezoidal, etc.

In some implementations, a method of using the small item holder can comprise the steps of: guiding small items, e.g., coins, into the first compartment; passing the small items from the first compartment to the second compartment; and folding the pocket at the centerline so that the first compartment is folded onto the second compartment thereby trapping the small items within the second compartment.

In some implementations, the second compartment is substantially closed off by the guide stich and partition stich so as to hold small items. In some implementations, the folded pocket is sized to fit into a change pocket a clothing article.

DETAILED DESCRIPTION

A small item holder for holding coins and other small items includes a pocket that can be opened on one side and can be formed from a thin material. The pocket can include a guide stich having a first end in close proximity to a corner of the pocket near the opening and a second end at a centerline of the pocket slightly below the opening. The guide stich can be sewn at a downward angle from the first end to the second end with respect to the opening. The pocket can further include a partition stich being partially sewn along the centerline of the pocket. The partition stich can start at the second end of the guide stich and continue to an approximate midpoint of the centerline. The partition stich partitions the pocket into a first compartment and a second compartment with the first compartment and the second compartment being interconnected.

Figure 1:
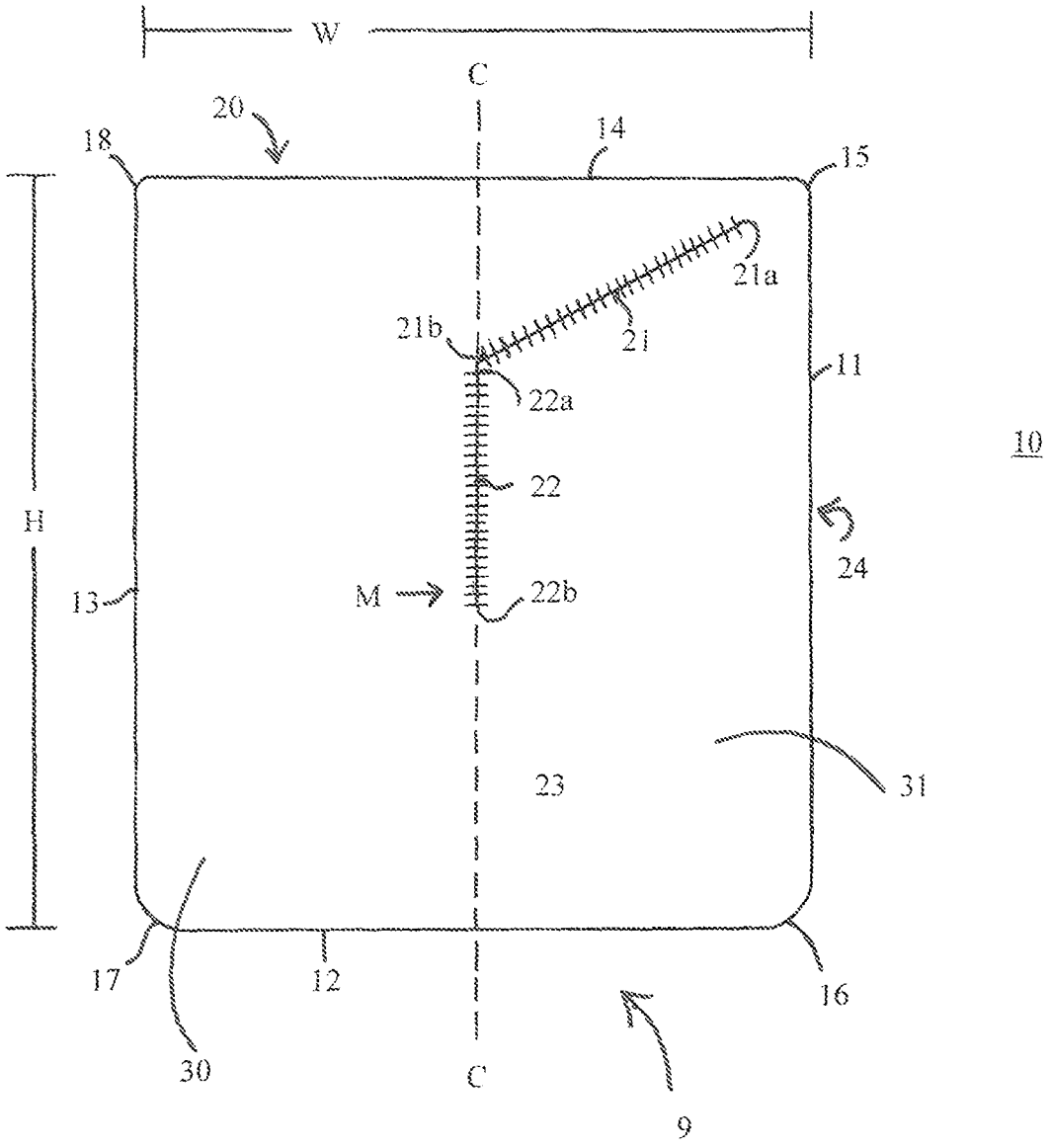
FIG. 1 is a side view of a small item holder of the disclosed technology.
Figure 2:
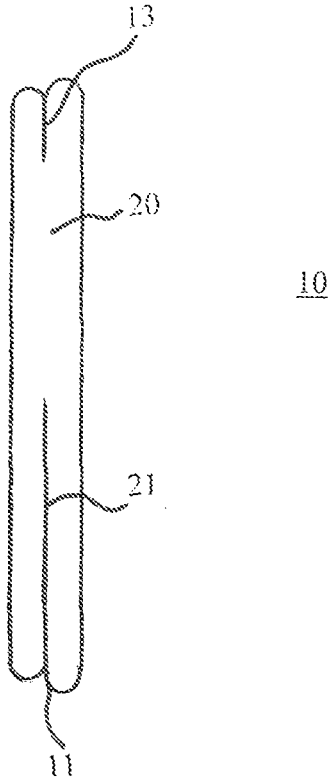
FIG. 2 is a top view of a small item holder of the disclosed technology.
Figure 3:
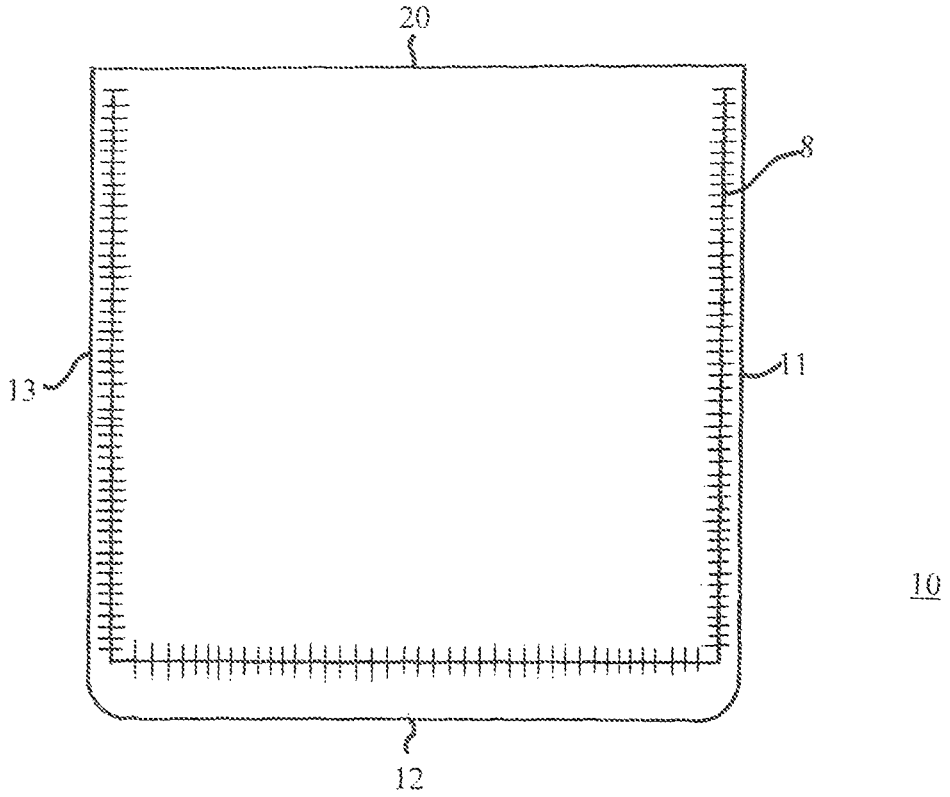
FIG. 3 is a side view of an inside-out small item holder of the disclosed technology.
Figure 8A:
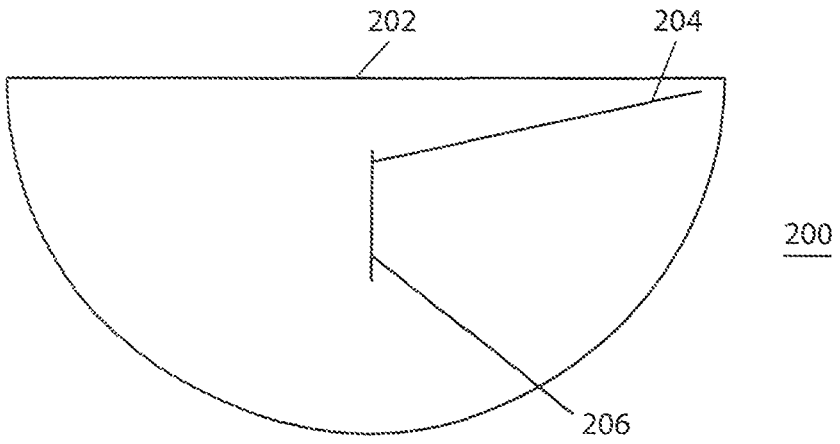
FIGS. 8*a-b* are side views of a small item holder according to another implementation of the disclosed technology.
Figure 8B:
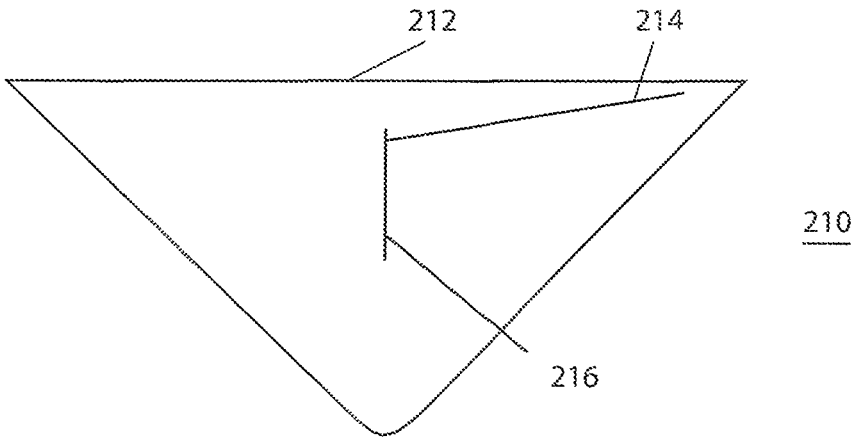

As shown in FIGS. 1 and 2, the small item holder 10 has four sides 11-14 and four corners 15-18. Three of the four sides 11-13 are sewn closed with an edge stich 8 (as shown in FIG. 3) allowing a fourth side 14 to remain open forming a pocket 9 with opening 20. In one implementation, the pocket 9 resembles a square but other shapes, e.g., rectangles, ovals, trapezoids, semi-circles, triangles, etc., are contemplated. (See, e.g., FIGS. 8*a* and 8*b* showing small item holders 200 and 210 having openings 202, 212, guide stiches 204, 214 and partition stiches 206, 216, respectively.)

The small item holder 10 can be constructed using a thin material, e.g., synthetic or organic materials having a thickness of 0.05-0.6 mm. For example, the thin material can be a spun-bonded olefin material made by combining continuous fibers of high density polyethylene into a sheet through a process using heat and pressure.

Spun-bonded olefin materials are paper-thin, elastic, waterproof, long-lasting, very strong and difficult to tear but can easily be cut with scissors or a knife. Spun-bonded olefin materials also allow water vapor to pass through but not liquid water. Spun-bonded olefin materials can be made in part from post-consumer recycled plastic and are 100% recyclable. As an elastic material, the spun-bonded olefin material fibers can expand with use. The spun-bonded olefin material superficially resembles paper in that it is as thin as paper and can be written and printed on. One such spun-bonded olefin material is sold under the trade name TYVEK®. TYVEK® is approximately 0.15-0.3 mm thick and white in color. It comes in rolls ranging in width from 0.91 m to 2.90 m and in length from 30.5 m to 60.9 m.

Other materials besides the spun-bonded olefin material can be utilized, e.g., thin leathers, laminated paper, plastics, waterproof and non-waterproof fabrics and various forms of cloth are contemplated.

Once the pocket 9 is formed, other stiches can be sewn into the pocket to form the small item holder. In one implementation, a guide stich 21 is sewn into the pocket 9 and closes part of the opening. The guide stich 21 is stitched through the pocket so that the stich extends from the front side 23 of the pocket to the rear side 24 of the pocket. The guide stich 21 can be made using any thread type and any stich. Typical threads include nylon, cotton, or combinations thereof as well as any other suitable threading material. If using a flexible plastic, e.g., PVC as the thin material, the guide stich can be impressed on the plastic using heat-molding techniques.

The guide stich 21 can have a first end 21*a* that is in close proximity to a corner 15 of the pocket 10 near the opening 20 and a second end 21*b* at a centerline C of the pocket 9 slightly below the opening 20. The guide stich 21 can be sewn either parallel to or at a downward angle from the first end 21*a* to the second end 21*b* with respect to the opening 20. The downward angle can be any angle between 0-60 degrees. The downward angle is advantageous because it allows coins to roll down the guide stich 21 into the pocket opening.

A partition stich 22 can also be sewn into the pocket 9. The partition stich 22 can be partially sewn along the centerline C of the pocket 9. The partition stich can start at the second end 21*b* of the guide stich 21 and continue to an approximate midpoint M of the centerline C. The partition stich has a first end 22*a* and a second end 22*b*. The partition stich 22 partitions the pocket 9 into a first compartment 30 and a second compartment 31. If using a flexible plastic, e.g., PVC as the thin material, the partition stich can be impressed on the plastic using heat-molding techniques.

The first compartment 30 opens into opening 20 and is also interconnected to the second compartment 31 below the partition stich 22. The second compartment is closed off to the opening 20 and only can be accessed by the interconnection with the first compartment. That is, the second compartment is substantially closed off by the guide stich and partition stich so as to hold coins and other small items. In some implementations, the guide stich and partition stich may be combined into a single curved stich that forms the second compartment.

The small item holder 10 can be designed by printing or painting aesthetic designs on the small item holder. Printing can be done using a press and ink specially designed to print on spun-bonded olefin materials. If other materials are used, designs can be painted on the small item holder instead of using a printing process. The paint can be added using a machine or hand-painted.

During manufacture, a roll of a spun-bonded olefin material is printed with a design. The printing can be done by using a press and ink specially designed to print on this type of material. Other types of printing can include off-set printing, silk screening, or standard printing techniques. The material can be die-cut using a laser-cut die for ultimate precision or the material can be hand-cut using a pair of scissors or a knife. In any case, the material can be cut into two approximate 3.5 inch squares (other sizes and shapes can be utilized). The squares are laid on top of one another with the design sides facing one another. As shown in FIG. 3, the edges 11-14 are sewn together with an edge stich 8. Sewing is done using a certain gauge thread and stich type. One edge of the material is not sewn so that a pocket can be formed. The pocket is then turned inside-out so that the design sides are visible and the edge stitching is not shown. The guide stich and partition stich are then sewn onto the pocket. These stiches can be done separately or as one continuous stich. Once these stiches are done, the small item holder is ready for use.

Figure 4:
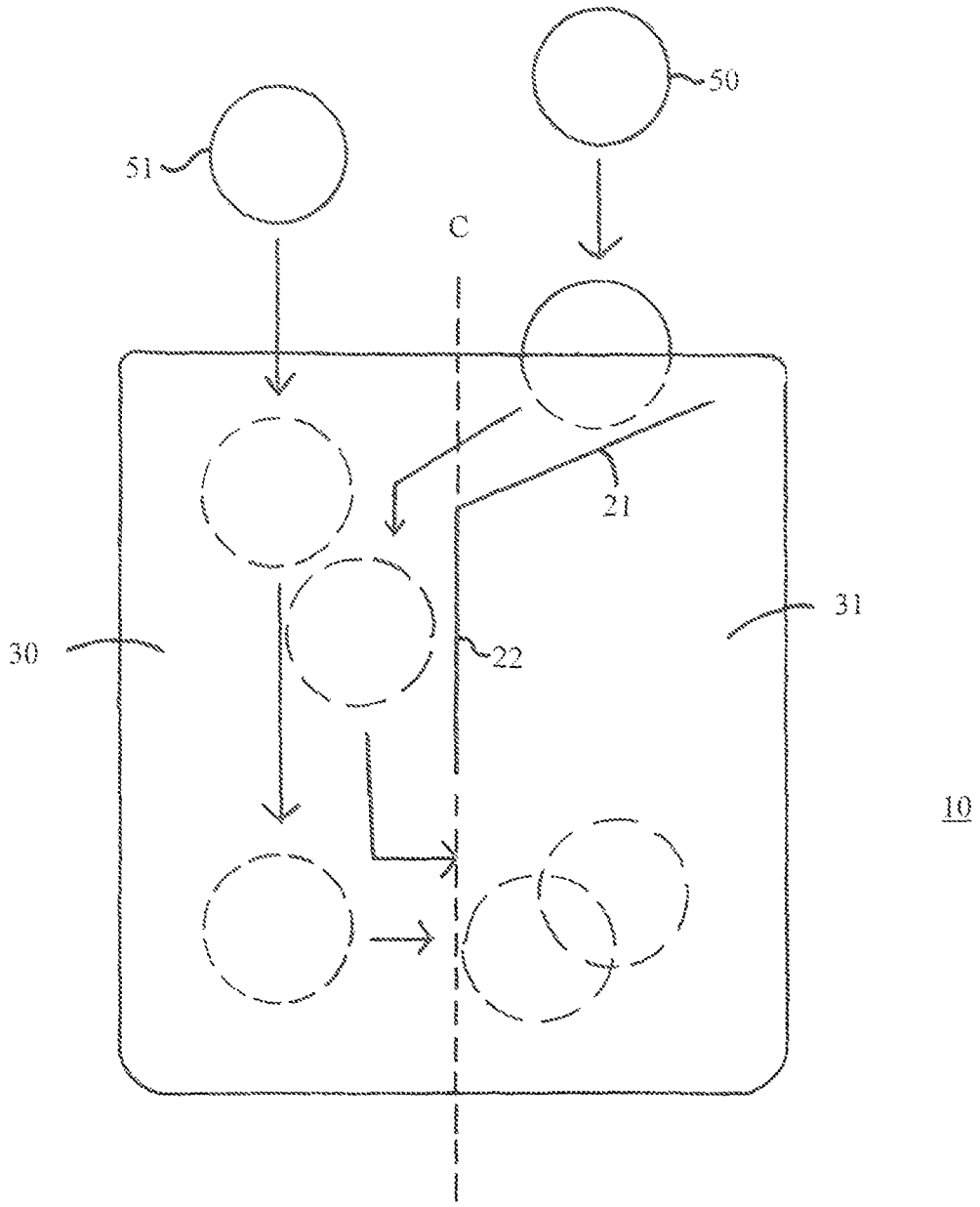
FIG. 4 is an illustrative view of small items going into the small item holder.
Figure 5:
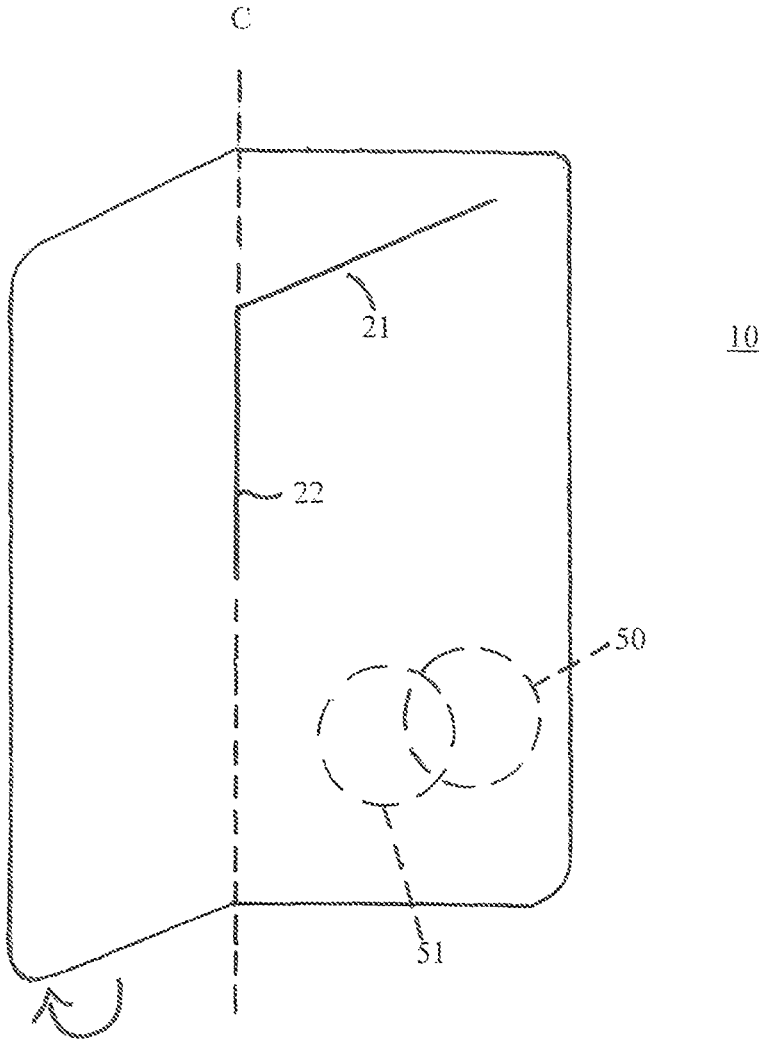
FIG. 5 is an illustrative view of folding of the small item holder.
Figure 6:
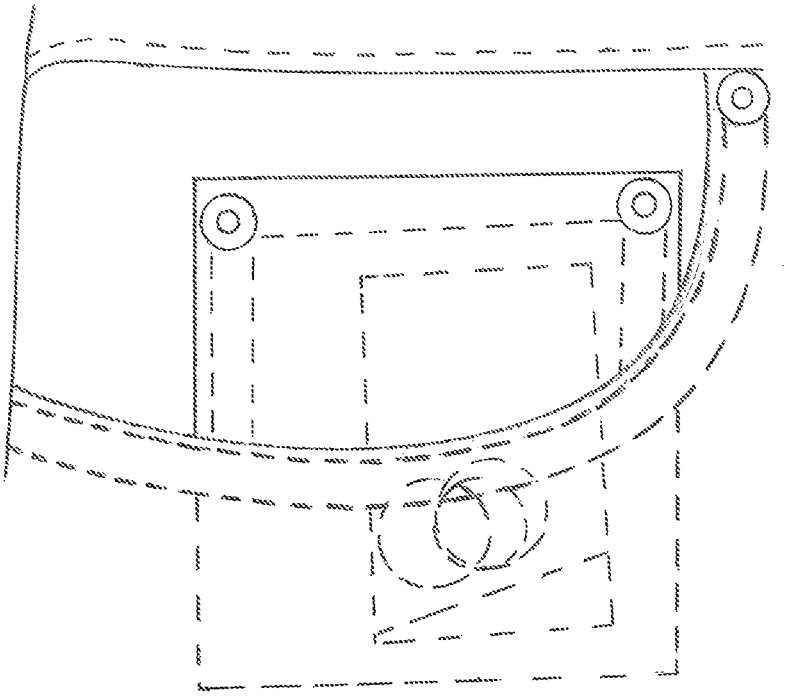
FIG. 6 is an illustrative view of a small item holder in a change pocket.

FIG. 4 illustrates an example in use wherein a user will hold the small item holder with the opening facing up. The user can drop a coin(s) 50, 51 into the opening 20. The coins 50, 51 can fall directly into the first compartment 30 or the guide stich 21 can allow the coins 50, 51 to roll along the guide stich 21 and drop to the bottom of the first compartment 30. Once the coins 50, 51 reach the bottom of the first compartment 30, the user can tilt the small item holder 10 so that the coins 50, 51 are passed through interconnection of the first compartment 30 and second compartment 31 and placed into the second compartment 31. Once all the coins 50, 51 are in the second compartment 31, the user will fold the first compartment 30 over the second compartment 31 at or near the centerline, as shown in FIG. 5, so that the coins 50, 51 are trapped or secured within the second compartment 31. The small item holder 10 is of a size that it fits into a change pocket 70 of a clothing article 71, as shown in FIG. 6.

Figure 7:
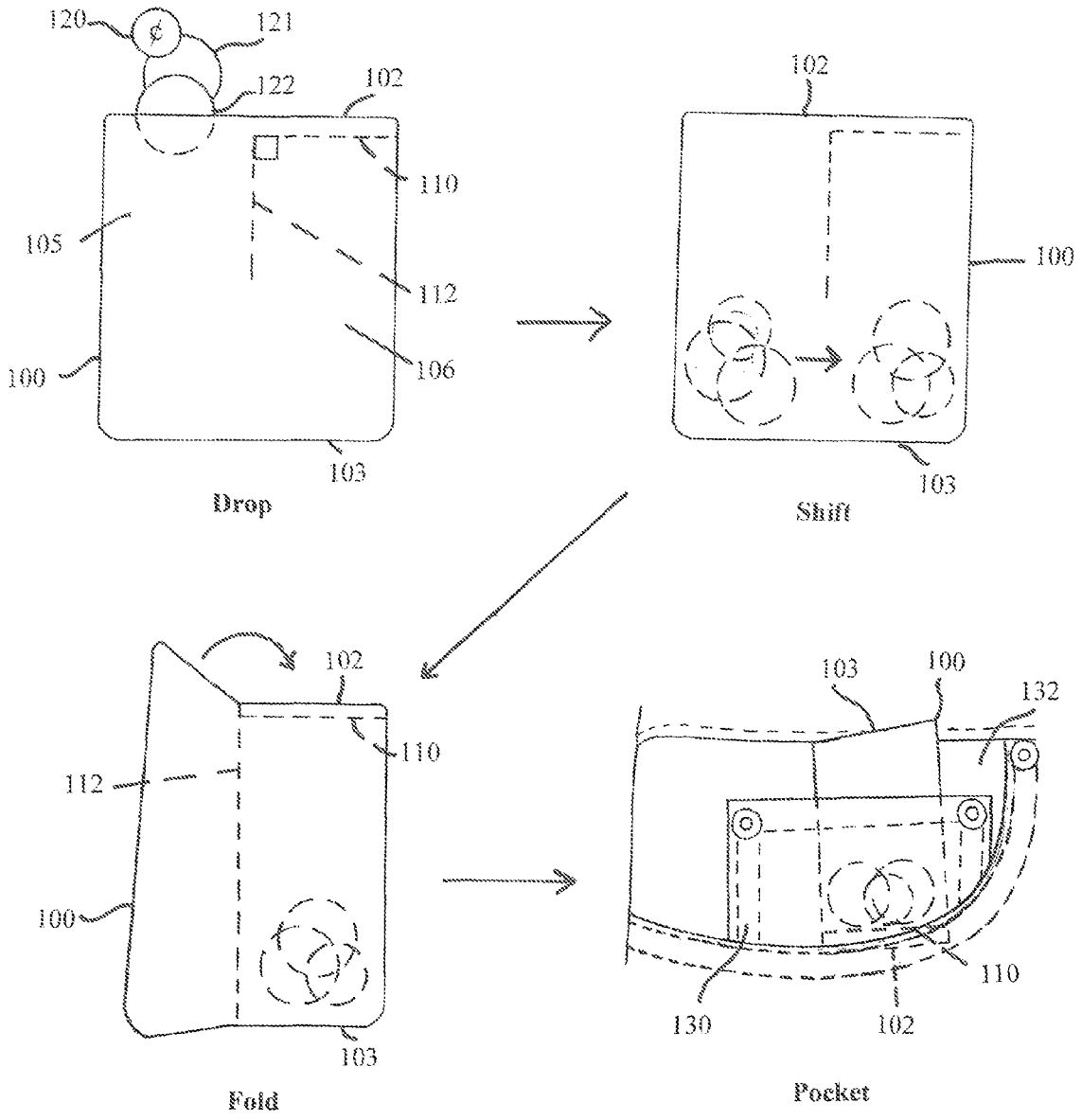
FIG. 7 is a flow diagram illustrating a use of a small item holder.

FIG. 7 illustrates the steps of putting coins 120-122 into a small item holder 100. In FIG. 7, small item holder 100 has a guide stich 110 that is approximately parallel to a top edge 102 of holder 100. The guide stich 110 also meets partition stich 112 at an approximate right angle. In this example, the bottom edge 103 of the small item holder 100 is straight but other shapes are contemplated, e.g., the bottom edge 103 can be round or V-shaped. The round or V-shaped bottom edge can allow coins, for example, to collect at a midpoint of the bottom edge and make it easier for a user to transition coins from an open side 105 to a partition side 106 and vice versa.

In use, a user can deposit coins 120-122 into an open side 105 of the holder 100. The coins can then drop to the bottom edge of the holder 100. The user can then shift the coins 120-122 from the open side 105 to a partition side 106 of the holder 100. The user then folds the open side 105 onto the partition side 106 or vice versa along the partition stich 112 thereby securing the coins on the partition side 106 of the holder 100. Once the coins 120-122 are secured within the partition side 106, the holder 100 can be slid into a pocket 130 of a clothing article 132. The holder 100 can be inserted into the pocket with the guide stich 110 inserted first so that the guide stich 110 is at a bottom of the pocket 130 insuring the coins 120-122 are secured within the partition side 106.

An additional use of the holder in the above operation is to insert important papers (not shown), e.g., currency, in between the fold of the open side 105 and partition side 106 to better secure the papers (not shown) within the pocket 130 of the clothing article 132.

While this specification contains many specific implementation details, these should not be construed as limitations on the scope of the disclosed technology or of what can be claimed, but rather as descriptions of features specific to particular implementations of the disclosed technology. Certain features that are described in this specification in the context of separate implementations can also be implemented in combination in a single implementation. Conversely, various features that are described in the context of a single implementation can also be implemented in multiple implementations separately or in any suitable subcombination. Moreover, although features can be described above as acting in certain combinations and even initially claimed as such, one or more features from a claimed combination can in some cases be excised from the combination, and the claimed combination can be directed to a subcombination or variation of a subcombination.

The foregoing Detailed Description is to be understood as being in every respect illustrative, but not restrictive, and the scope of the disclosed technology disclosed herein is not to be determined from the Detailed Description, but rather from the claims as interpreted according to the full breadth permitted by the patent laws. It is to be understood that the implementations shown and described herein are only illustrative of the principles of the disclosed technology and that various modifications can be implemented without departing from the scope and spirit of the disclosed technology.

What is claimed:

1. A small item holder comprising:

a pocket having an opening on one side, the pocket being formed from a thin material;

a guide stitch having a first end in close proximity to a corner of the pocket near the opening and a second end at a centerline of the pocket slightly below the opening, the centerline being approximately equidistant from a left side and a right side of the pocket, the guide stitch being a straight line stitch positioned parallel to or at an angle with respect to the opening; and a partition stitch being positioned along the centerline of the pocket, the partition stitch starting at the second end of the guide stitch and continuing to an approximate midpoint of the centerline, the partition stitch partitioning the pocket into a first compartment and a second compartment, the first compartment and the second compartment being interconnected.

2. The small item holder of claim 1 wherein the thin material is a spun-bonded olefin material.

3. The small item holder of claim 2 wherein a design is printed on the spun-bonded olefin material.

4. The small item holder of claim 1 wherein the thin material is a thin leather.

5. The small item holder of claim 1 wherein the thin material is a flexible plastic.

6. The small item holder of claim 1 wherein the thin material is laminated paper.

7. The small item holder of claim 1 wherein the thin material is a fabric.

8. The small item holder of claim 1 wherein the thin material is a cloth material.

9. The small item holder of claim 1 wherein the first compartment and the second compartment are interconnected below the partition stitch.

10. The small item holder of claim 1 wherein the angle of the guide stitch is a downward angle of approximately 0-60 degrees with respect to the opening.

11. The small item holder of claim 1 wherein the pocket has four sides or is a half circle.

12. The small item holder of claim 1 wherein the pocket is square, rounded or V-shaped.

13. A method of using the small item holder of claim 1, the method comprising the steps of: guiding small items into the first compartment; passing the small items from the first compartment to the second compartment; and folding the pocket at the centerline so that the first compartment is folded onto the second compartment thereby trapping the small items within the second compartment.

14. The small item holder of claim 13 wherein the second compartment is substantially closed off by the guide stitch and partition stitch so as to hold small items.

* * * * *